US006305447B1

(12) United States Patent
Rousseau

(10) Patent No.: US 6,305,447 B1
(45) Date of Patent: Oct. 23, 2001

(54) BASE PLATE FOR MOUNTING ROUTER IN A SUPPORT TABLE

(76) Inventor: Tony Rousseau, 1712 - 13th Ave., Clarkston, WA (US) 99304

( * ) Notice: Subject to any disclaimer, the term of this patent is extended or adjusted under 35 U.S.C. 154(b) by 0 days.

(21) Appl. No.: 09/648,970

(22) Filed: Aug. 28, 2000

(51) Int. Cl.[7] ..... B27C 5/00; B25H 1/00

(52) U.S. Cl. ..... 144/135.2; 144/137; 144/286.1; 144/371

(58) Field of Search ..... 144/1.1, 134.1, 144/135.2, 136.1, 137, 286.1, 286.5, 371, 136.95, 154.5; 83/477.2; 409/180, 181, 182

(56) References Cited

U.S. PATENT DOCUMENTS

| | | | | |
|---|---|---|---|---|
| 2,615,479 | | 10/1952 | Bearup . | |
| 3,342,226 | | 9/1967 | Marcoux et al. . | |
| 4,265,283 | | 5/1981 | Nash et al. | 144/286.1 |
| 4,350,193 | | 9/1982 | McCambridge et al. | 144/286.1 |
| 4,635,692 | | 1/1987 | Hulse et al. | 144/286.1 |
| 4,719,951 | | 1/1988 | Woltanski | 144/253.2 |
| 4,774,986 | | 10/1988 | LaGra . | |
| 5,289,861 | * | 3/1994 | Hedrick | 144/135.2 |
| 5,398,740 | * | 3/1995 | Miller | 144/286.1 |
| 5,611,378 | | 3/1997 | Brazell | 144/135.2 |
| 5,699,844 | * | 12/1997 | Witt | 144/135.2 X |
| 5,715,880 | | 2/1998 | Tucker et al. | 144/286.1 |
| 5,725,036 | * | 3/1998 | Walter | 144/135.2 |
| 5,725,038 | * | 3/1998 | Tucker et al. | 144/135.2 X |
| 5,816,300 | | 10/1998 | Rogers | 144/136.95 |
| 5,970,835 | * | 10/1999 | Kenyon et al. | 144/286.1 X |

* cited by examiner

*Primary Examiner*—W. Donald Bray
(74) *Attorney, Agent, or Firm*—Keith S. Bergman

(57) ABSTRACT

A base plate for mounting a router in a support table provides a plate configured to fit in an orifice, having an inwardly extending ledge thereabout, defined in the support table with the router supported by the base plate to depend therefrom. The base plate defines a medial orifice for passage of the router shaft through the orifice for operative positioning of a cutter carried on the router shaft above the base plate. The base plate medial orifice releasably carries plural annular inserts to cover space between the router shaft and the support plate portion defining the medial orifice. Plural adjustment screws are carried in threaded engagement in the ledge of the support surface orifice for vertical motion to adjustably move adjacent portions of the base plate periphery upwardly from the ledge to create a coplanar relationship of adjacent portions of the base plate and support table. The base plate carries at least one releasably adjustable fastener to fasten the support plate on the ledge in the orifice defined in the support table.

7 Claims, 3 Drawing Sheets

BASE PLATE FOR MOUNTING ROUTER IN A SUPPORT TABLE

BACKGROUND OF INVENTION

1. Related Applications

There are no applications related hereto heretofore filed in this or any foreign country.

2. Field of Invention

This invention relates generally to workbenches and more particularly to a workbench defining a medial orifice to releaseably carry a base plate supporting a depending router with the router blade in operative position above the support table.

BACKGROUND AND DESCRIPTION OF PRIOR ART

With the advent and development of modern powered hand tools of substantial sophistication, it has become popular to operatively support those tools in or on some type of table-like support to provide more functional utility that often approaches the functional utility of a large stationary tool of the same type, but with substantially less overall costs. Various of such supports have become known and provided for handsaws, drills, planers, routers and the like and some such supports have become known to service more than a single type of such tools. These supports in general provide a flat planar support surface defining a medial orifice to carry the tool, or some associated base plate carrying the tool, in a functionally depending fashion with the tool operative mechanism extending upwardly through the orifice and spacedly above the support table for use.

This type of support has been found particularly useful with hand manipulatable powered routers and various supports and base plates for such routers have heretofore become known. Though these supports have had substantial historicity and during their historical period have become increasingly sophisticated, problems still remain with their use. The instant base plate for mounting a router in a support table seeks to lessen or resolve various of these still existing problems.

It generally is desirable and has become well known to mount a powered hand tool on a mounting base plate to be carried in a support table orifice. This allows convenient and easy mounting and removal of the tool as desired not only to allow the support surface to mount other tools, but also to allow an orifice defined in the support surface to be covered by an insert so that it may serve as an ordinary planar support surface. The use of base plate type tool mounting also allows the formation of the base plate from material different from that from which the support surface is formed.

Commonly, the area about a tool operatively carried in a support surface, needs to be stronger, more rigid and more durable than the support surface distal from the tool as the support plate surface adjacent to the tool commonly receives most wear, use and physical abuse to shorten its effective life. This area yet requires configurational maintenance and oftentimes fine configurational definition, for the support plate to be effectively operable with the tool, especially in the case of a router. Though various problems have existed with support plates that have heretofore become known, the advantages of such plates have out-weighed their disadvantages and the plates have come into common use.

A simple and the most commonly used method of supporting a tool base plate in a support surface has been to define in the support surface an orifice having an inwardly extending lip about its lower peripheral portion so that the periphery of the tool base plate may be supported on that lip with the peripheral surface of the base plate substantially adjacent the peripheral surface defining the support surface orifice. It is convenient, and sometimes necessary, that the upper surfaces of the support surface and tool base plate be substantially coplanar, but often this requires adjustment to accommodate irregularities and inaccuracies of the configurational definition either the support surface, the orifice therein or the base plate periphery. This problem has commonly been resolved by shimming the adjacent surfaces of the elements or providing screw type adjustment means in the peripheral area of the base plate or lip area of the support surface orifice to extend to contact the adjacent element surface so that the adjustment screws may be moved to bring the base plate surface into coplanar relationship with the support table surface.

In general such base plates have commonly been maintained on the support surface ledge by means of gravity, as the support surface normally is horizontally or at least somewhat horizontally oriented. In some instances the base plate has been fastened in the support orifice by fasteners operably extending therebetween, most commonly bolts or screws. This method of fastening is inconvenient in general and especially when the tool base plate must be removed and replaced frequently, as is commonly the case. Additionally, support tables commonly are formed of wood or derivatives having similar properties and the use of either bolt or screw type fasteners in such material is fairly rapidly destructive of the fastening areas, so as not to allow frequent fastening and unfastening and soon make such fastening less secure, even if operative.

The instant base plate resolves this problem by allowing formation of the base plate from more dense polymeric or resinous plastics to provide a strong, durable and rigid fastening structure and by providing a particularly designed releasable fastener. This releasable fastener provides a bolt extending through the fastening plate to carry each of one or more elongate fastening dogs, with a nut on the surface of the fastening dog distal from the support surface so that the fastening dog may be secured upon the support surface adjacent to the base plate without any direct fastenable contact of the bolt with the material of the support surface. This fastening method allows the fastening dog to be secured with an adjustable amount of tension between it and the support surface to allow or prevent fastening and release of the base plate by rotation of the fastening dog on the bolt.

Another problem often presented by a tool carrying base plate, and especially those used with routers, is that the base plate surface closely adjacent to the cutting tool extending therethrough may be lower than the upper surface of the surrounding support table, even though the periphery of the base plate is coplanar with the upper surface of the support table. The condition of either base plate or support table may change with use and wear, and commonly, the base plate surface closely adjacent to the cutting tool may be worn and abraded by use to a greater extent than more distal areas to become lower than the surface of the support table. It is desirable in operating router and shaper tools that the base plate surface immediately adjacent the cutting element be substantially coplanar with the more distal support surface, or at least be not lower than that support surface. The instant base plate provides a slightly raised medial portion to avoid this problem and accommodate the abrasion occurring from normal use without lowering the upper surface of the base plate below desired limits.

My invention resides not in any one of these features individually, but rather in the synergistic combination of all of its structures that necessarily give rise to the functions flowing therefrom as herein specified and claimed.

SUMMARY OF INVENTION

The instant invention provides a base plate for mounting a depending powered hand router within a lower lipped orifice defined in a support table. The base plate defines a medial orifice releasably carrying plural selectively positionable concentric inserts to allow passage of the shaft and cutter of the supported router therethrough and spacedly thereabove. The base plate or orifice of the support table lip provide plural leveling screws in the adjacent areas to communicate therebetween to adjustably position the upper surface of the base plate in substantially coplanar relationship with the upper surface of the support table. Corner fasteners about the peripheral area of the base plate depend beneath the support table to carry fastening dogs for selective adjustable motion to releasably and positionally maintain the base plate in the support table orifice.

In providing such a device it is:

A principal object to create a base plate for mounting a depending powered hand router for releasable positional maintenance in a lipped orifice defined in a support table.

A further object is to provide such a base plate that defines an adjustable medial orifice to allow upward passage of the shaft and cutter of a depending router therethrough and spacedly thereabove for proper operative positioning spacedly above the support table.

A further object is to provide such a base plate that has plural spaced leveling screws communicating between in the peripheral area of the base plate and the adjacent table lip to adjustably position the upper surface of the periphery of the support plate relative to the upper surface of the support table adjacent thereto.

A further object is to provide such a support plate that has a slightly raised medial portion spacedly adjacent the cutter orifice defined therein to compensate for wear and assure that the supporting area about the cutter is no lower than the support table surface about the base plate.

A still further object is to provide such a base plate that is formed of a strong, rigid and durable polymeric or resinousness plastic to prevent excessive wear, damage from impact and pressure type intrusive forces and to maintain configurational integrity to a substantially greater extent than traditional wood or wood-like support tables.

A still further object is to provide such a support plate that has at least one releasable fastener carried in the peripheral area to extend below the support plate to carry a fastening dog that is adjustably tightenable against the lower surface of the support table to positionally maintain the support plate in the support table orifice.

A still further object is to provide such a base plate that is of new and novel design, of rugged and durable nature, of simple and economic manufacture and one otherwise well adapted for the uses and purposes for which is intended.

Other and further objects of my invention will appear from the following specification and accompanying drawings which form a part hereof. In carrying out the objects of my invention however, it is to be remembered that its accidental features are susceptible of change in design, number and structural arrangement with only one preferred and practical embodiment of the best known mode being illustrated in the accompanying drawings and specified as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 1:
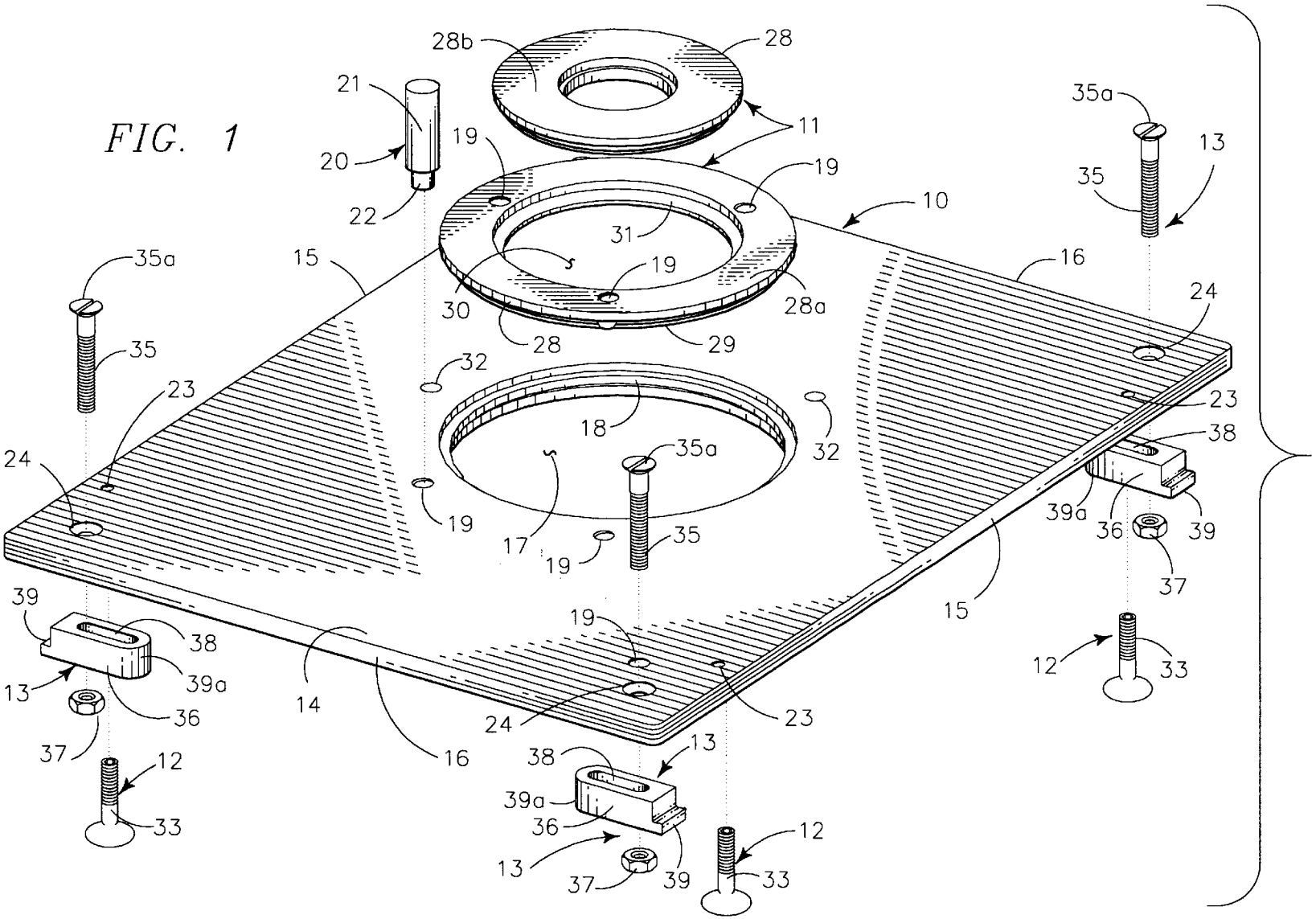
FIG. 1 is an expanded isometric view of my base plate, showing various of its parts, their configuration and relationship.

As seen in FIG. 1 the instant mounting structure provides base plate 10 defining a medial orifice carrying plural inserts 11 and having plural levelers 12 and corner fasteners arrayed 13 about the peripheral edges.

Base plate 10 in the instance illustrated provides rigid flat substantially planar plate 14 defined by similar longer sides 15 and shorter ends 16, the upper edges of which are coplanar. The illustrated generally rectilinear peripheral configuration of the plate 14 is not essential and other peripheral configurations are within the ambit and scope of my base plate, though the rectilinear configuration illustrated, or one of similar geometry, generally make more simple the formation of an orifice in a support table to receive the base plate. The entire upper surface of the plate 14 may be coplanar, but preferably is formed as a portion of a truncated right circular cone having a very shallow side slope of approximately one degree to provide a raised medial portion of the upper surface of the support plate a few hundredths of an inch above the level of the sides 15 and ends 16 to assure that the medial portion of the plate is higher than any other portion. This also provides an area that can sustain substantial wear generated by normal use without becoming lower than peripheral portions of the upper surface of the plate.

The medial portion of plate 14 defines circular router bit orifice 17 having annular radially inwardly extending rim 18 in its vertically medial portion to receive and support an annular insert in the orifice. The plate 14 defines spaced guide post holes 19, in the instance illustrated three in number. These holes 19 extend at least partially through the plate 14 to receive guide pin 20 and frictionally maintain it to extend spacedly upward from the upper surface of the plate to aid free hand guiding of a workpiece to be shaped by a router supported by the plate. Guide pin 20 provides upper radially larger cylindrical body 21 and radially smaller lowermost fastening shaft 22 to maintain the guide in a hole 19 in upstanding vertical orientation with predetermined upward vertical extension relative to the plate 14.

Plate leveler holes 23 are defined in spaced relationship inwardly adjacent side edges 15 of the plate to optionally allow access to leveler screws therebeneath carried in the lip of the underlying support table to level the support plate in operative relationship in the support table. Corner fastener holes 24 are defined in the plate 14 spacedly inwardly adjacent each corner of the plate to extend through the plate to carry bolts of corner fasteners 13.

Figure 2:
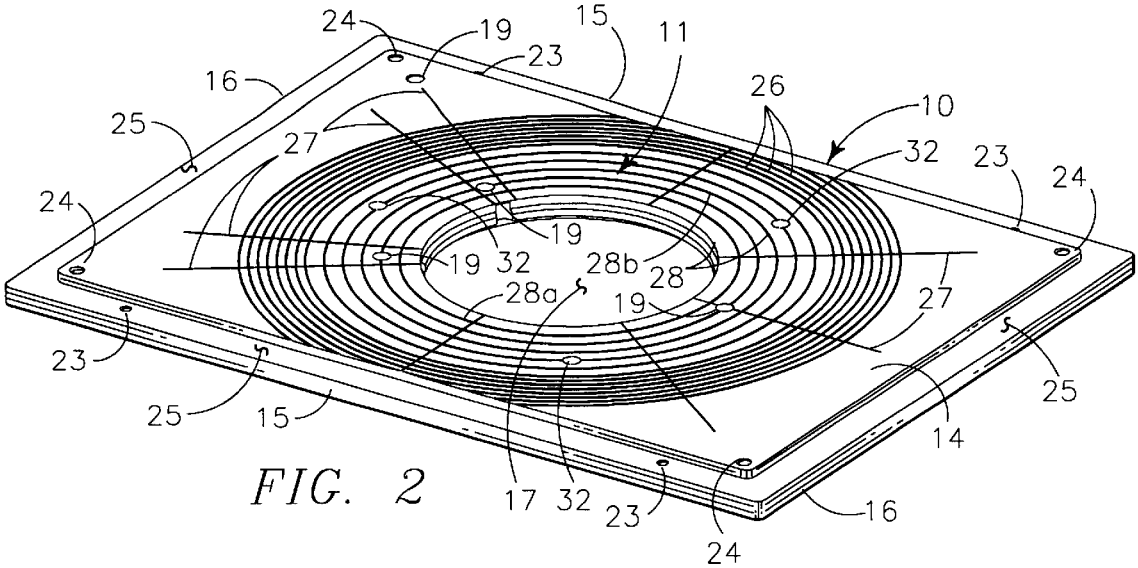
FIG. 2 is an isometric view of the bottom of the base plate of FIG. 1 taken from a different aspect.

The lower surface of plate 14, as seen in FIG. 2, defines continuous peripheral groove 25 extending spacedly inwardly from its sides and ends. This groove is not necessary to allow the plate to function, but is convenient and desirable in allowing a plate with a thicker medial portion, providing a mortice-like interconnection of the base within an orifice appropriately configured in a support table and in tending to center the plate 14 in the support table orifice. The lower surface of the support plate, inwardly of the peripheral groove 25, provides centering indicia in the form of concentric rings 26 and radially extending lines 27 to aid positioning a router to be carried by the support plate when creating fastening holes required to fasten the router to the support plate. The rings 26 and lines 27 may be raised or etched elements defined in or on the lower surface of the plate 14 or may be printed thereon by known methods. If the plate 14 is created by molding it is convenient to etch these rings and lines in the mold to produce slightly raised protuberances in the molded product.

As seen especially in FIG. 1 inserts 11 comprise interfitting annular rings 28, in the instance illustrated two in number. The radially larger annular ring 28*a* has a diameter to fit in supportative relationship within router bit orifice 17 and defines a lower annular groove 29 to fit radially inwardly adjacent annular rim 18 defined in the lower portion of the router bit orifice 17 in a cylindrical tongue and groove type interconnection. The inner surface of the larger ring 28*a* defines smaller ring orifice 30 having a lower radially inwardly extending rim 31 to support smaller annular ring 28*b* in a fashion similar to that in which the larger annular ring 28*a* is supported in plate 14. Additional smaller radial rings may be supported in the orifice of smaller ring 28*b* (not shown) or a covering disk (not shown)may be supported in the plate orifice 17 if desired.

Preferably, one or both of the circumferentially adjoining surfaces of the annular rings are angulated slightly toward each other to provide a frictional fit for positional maintenance of the ring in the structure carrying it. The upper surfaces of annular rings 28 preferably planar and the thicknesses of the rings, configuration and positioning of grooves and rims are so determined that when the rings are assembled concentrically in the base plate, the radially outer edge of each larger element is coplanar with the upper surface of the supported smaller ring.

In the instance illustrated, either annular ring 28 may define spaced guide post holes 19 extending therein or therethrough. These holes 19 may be of such number and array as desired by a particular user, are not essential to my invention and may be left to user creation if desired.

Figure 3:
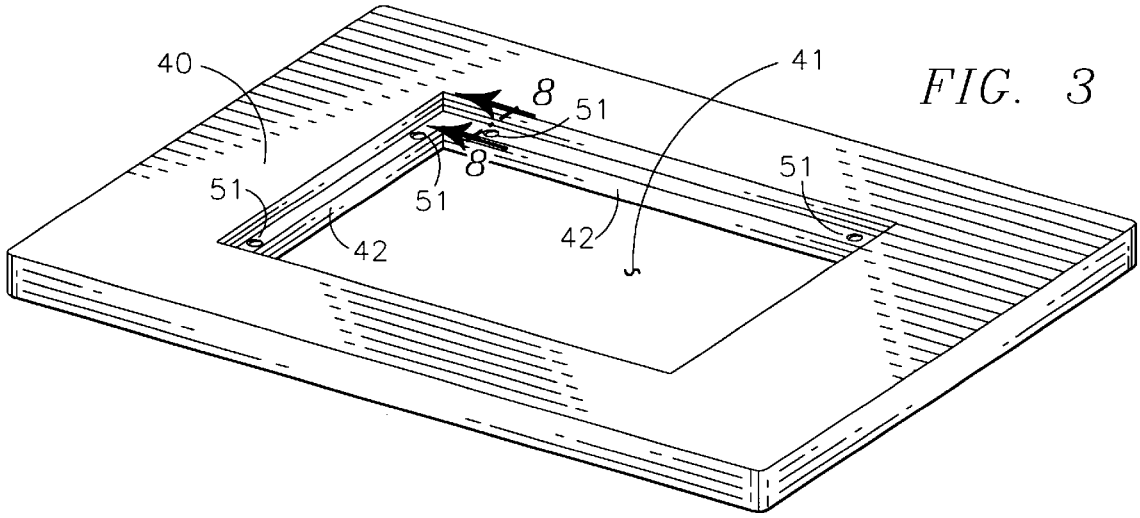
FIG. 3 is an isometric view of reduced scale of a common support table showing a typical lipped orifice defined therein that is configured to receive and support the base plate of FIGS. 1 and 2.

Levelers 12 provide plural screws 33 that are threadedly carried in holes 51 defined in and extending vertically through ledge 42 that extends inwardly into orifice 41 defined in support table 40, as seen in FIG. 3.

Figure 8:
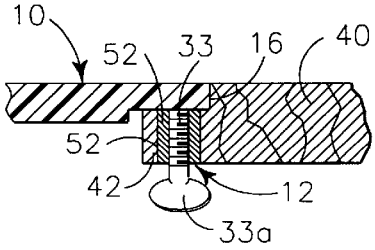
FIG. 8 is a cross-sectional view through a first species of a screw type leveler carried in the orifice lip of the support table of FIG. 3, taken on the line 8—8 thereon in the direction indicated by the arrows with a portion of a support plate shown in operative position for clarity.

Preferably, but not necessarily, holes 51 are provided with metallic sleeves 52 defining medial threaded holes within which screws 33 are threadedly engaged to provide a more secure and durable threaded interconnection of the screws in ledge 42, which commonly is formed of wood, pressed particulated wood board or similar material that does not well or long maintain a threaded configuration. If sleeves 52 are used they preferably have knurled outer peripheral surface and are maintained in ledge 42 by means of a pressed fit or by adhesive. The screws 33 illustrated in FIG. 8 have flat thumb screw type heads 33*a* to aid finger manipulation. These screws are inserted in holes 51 or sleeves 52 carried therein from the lower orifice of the holes so that the screws may be turned to move upwardly in the holes to contact the lower surface of a base plate periphery carried in support table orifice 41 to move a peripheral portion of the base plate selectively upwardly to an leveling of the plate with the support table surface. This type of screw 33 generally is manually manipulated from beneath the support table.

Figures 4, 5, 7, 9:
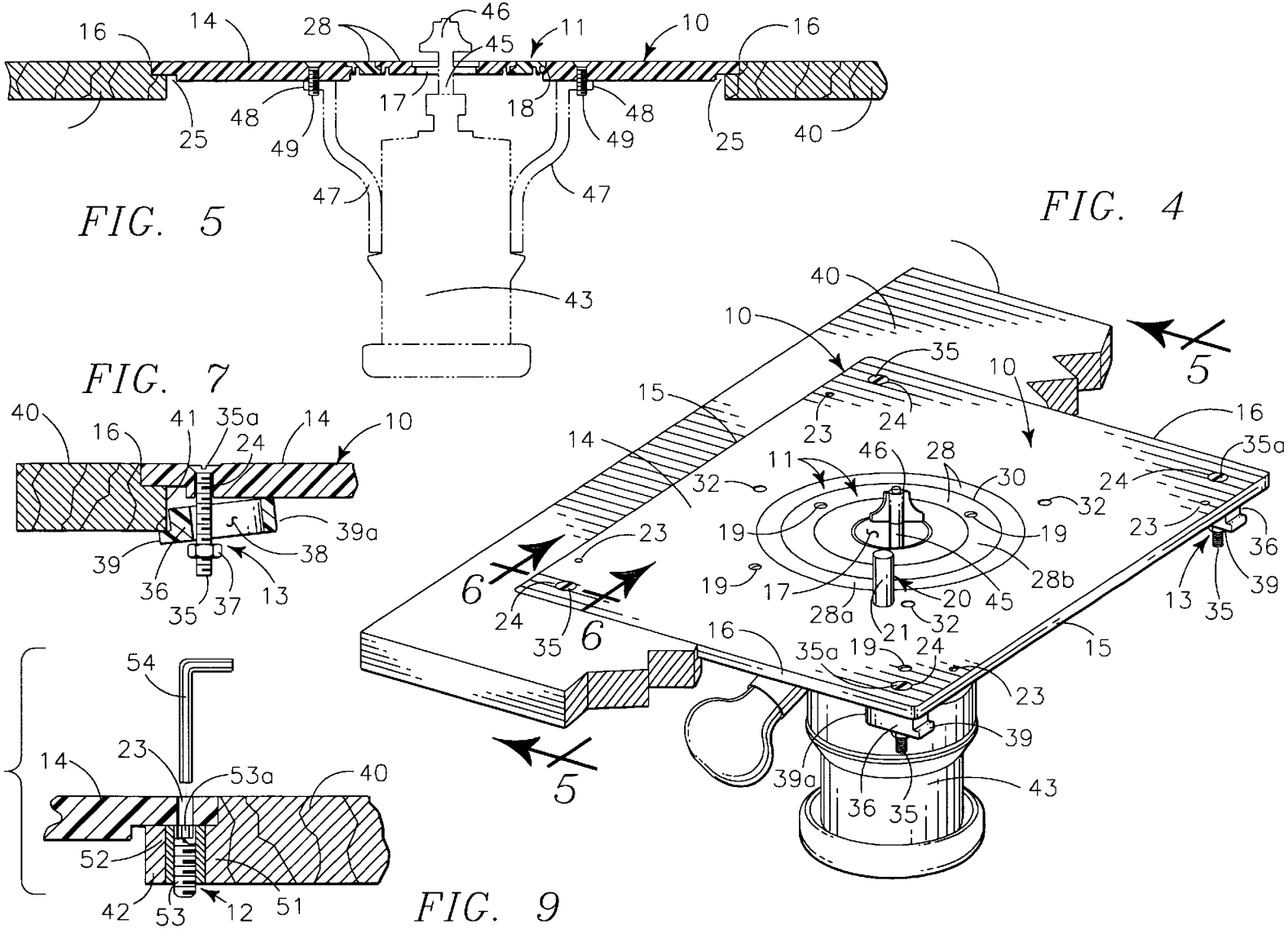
FIG. 4 is a somewhat enlarged partially cut away isometric view of a base plate carrying a router supported in the support table of FIG. 3.
FIG. 5 is a medial vertical cross-sectional view through the structure of FIG. 4, such as would appear on the line 5—5 thereon, if taken in the direction indicated by the arrows were the support table not cut away and with the router shown in phantom outline for clarity.
FIG. 7 is a somewhat enlarged cross-sectional view as would appear if taken on a line and in a direction similar to those attributes of FIG. 6, but showing the fastening structure in an angulated mode extending over the lip of the support table orifice.
FIG. 9 is a cross-sectional view through a second species of top adjustable screw type leveler as would appear if taken on a line and in a direction similar to the attributes of FIG. 8.

A second species of leveling screw shown in FIG. 9 provides set screws 53 having heads 53*a* with indented channels of hexagonal cross-sectional configuration to receive the end portion of a hexagonal wrench to rotate the screw. The holes 51 defined in ledge 42 to receive these set screws 53 are so positioned as to be axially coincident with and vertically beneath plate leveler holes 23 defined in the support plate. These holes 51 are preferably provided with metallic sleeves 52 of the same type as the sleeves provided for the first species screws 33. The set screws 53 are threaded into holes 51 through the upper orifice and after initial positioning the screws may be manipulated from above the support plate 10 by inserting a hexagonal wrench 54 through hole 23 and into operative contact with channel 53*a* in the head of the screw 53 therebelow to allow turning and vertical adjustment of that screw. The external diameter of the set screws 53 must be larger than the diameter of leveler holes 23 for the set screws to be operative.

Corner fasteners 13 provide bolts 35, with countersunk type heads 35*a*, extending through corner fastener holes 24 and spacedly therebelow to carry elongate fastening dogs 36 on their shanks beneath plate 14 with nuts 37 threadedly engaged on the bolts outwardly of and beneath the fastening dogs. The tapered heads 35*a* of the countersunk bolts 35 fit in appropriate chamfers defined in plate 14 about the upper portion of the corner fastener holes 24 so that the heads 35*a* do not project above the upper surface of the plate 14 to interfere with workpieces moving thereover. Preferably the nuts 37 provide an interconnected lock-washer type structure (not shown) on their inner surface facing the adjacent fastening dog to maintain fastenable interconnection after establishment.

Figure 6:
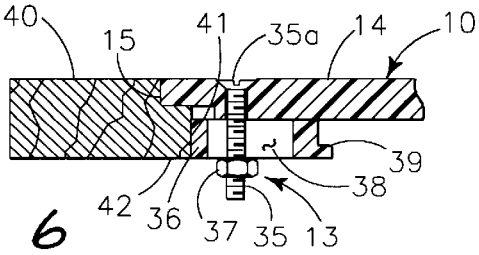
FIG. 6 is a enlarged partial vertical cross-sectional view, taken on the line 6—6 on FIG. 4 in the direction indicated by the arrows, to show the details of the fastening structure in a parallel mode.

The fastening dogs 36 have sufficient thickness to extend spacedly below the lower surface of support plate 10 and are of an elongate nature defining medial elongate vertical by orientated bolt slots 38 extending therethrough. The slots 38 have width incrementally greater than the diameter of bolts 35, so as to accept those bolts in sliding pivotal containment. A first end of each fastening dog defines fastening protuberance 39 extending outwardly from the lower portion of the end surface parallel to the elongate axis of slot 38, as illustrated especially in FIG. 1. The second end of each fastening dog defines a curved surface 39*a* in a vertical plane to allow the second end to fit with some friction in a corner defined by intersection of sides and ends of support table ledge elements 42. With this structure the fastening dogs 36 may be positioned at an adjustably variable distance beneath the support plate 10 with an angulated orientation and outward extension to contact a lower portion of a support table carrying the base plate to releaseably fasten the base plate in the support table orifice as shown in FIG. 7. The second end of one or more fastening dogs may be positioned so as to contact the inner vertical surface of the support table ledge elements 42 for frictional fastenable contact therewith as shown in FIG. 6.

Preferably, the support plate inserts and corner fasteners are formed of one of the harder, more rigid and dense polymeric or resinous plastics by known molding processes. The fastening bolts 35, leveling screws 33, 53 and guide pin 20 are preferably, but not necessarily, formed of metal because of the strength, rigidity and wear resistance required for these elements.

Having described the structure of my base plate, its use and function may be understood.

The base plate 10 is designed to be carried in an orifice 41 defined in an areally larger support table 40 seen in FIG. 3. The support table 40 commonly is a flat rigid element of 0.75 to 1.0 inch thicknesses with a substantially planar upper surface. The instant base plate is adapted for use with such a support table, though it also is quite useable with other support tables of differing natures and constructions, so long as a lipped orifice configured to carry the base plate as specified may be defined in the support table. The support table is supported at a convenient working height above a supporting surface by legs or other structures serving a similar purpose (not shown), but with vacant space of some volumn beneath the orifice 41 to allow mounting of the support plate with an interconnected depending powered router.

Orifice 41 is defined in the medial portion of the support table 40 to receive and support the base plate 10 by appropriate known methods. This orifice 41 is of a configuration similar to and size incrementally greater than the peripheral configuration and dimensions of the base plate and provides inwardly extending ledge 42 in the lower part of the orifice defining edges. The ledge 42 must be dimensioned and configured in relationship to the peripheral structure of the base plate which it is to carry so that the base plate periphery above lower peripheral groove 25 fits in immediate adjacency above the support table ledge 42 with the upper surface of the base plate edges substantially coplanar with, and at least not higher than, the upper surface of the support table, as illustrated in FIGS. 4–9. The width of lower peripheral groove 25 preferably is such as to position the portion of the base plate not defining the lower peripheral groove 25 immediately inwardly adjacent the inner vertical surfaces of ledge 42 for convenient and secure interconnection of the two members, but this configuration is not necessary and the groove may have a greater width as shown in the illustrations. If the upper surface of the base plate 10 at its peripheral edges is below the upper surface of the support table adjacent thereto, the base plate may be raised to bring its periphery into a coplanar relationship by turning the leveler screws 33, 53 upwardly so that they contact the lower surface of the base plate and responsively move the base plate upwardly relative to the support table until appropriate positioning is accomplished. The orifice 41 in the support table should be designed and configured with this adjustment process in mind so that if there is any error it is of a type that would make the upper surface of the base plate slightly lower than the upper surface of the support table and the upward adjustment of the base plate by use of the levelers may remedy any misalignment.

Router 43 to be carried by the base plate in modern day commerce provides a work support plate (not shown) to support the router on a workpiece when in a vertically upright position, with the router shaft 45 and cutter tool 46 thereon in a depending lowermost operative position. Routers of various manufacturers have work support plates of varying size and configuration, but all provide support arms 47 extending outwardly from the router body to interconnect the work support plate in operative position. Support arms 47 provide perpendicular extending feet 48 defining holes to allow passage of bolts 49 therethrough and into the work support plate to fasten it upon the support arms.

To use the instant base plate with such a router, the work support plate of the router is removed. support plate is positioned on the upturned lower surface of base plate 10 and preferably substantially centered on the base plate. Most router work support plates in modern day commerce are of a circular configuration and are commonly supported by three circumferentially spaced support arms 47 so the centering of such a plate on the instant base plate may be effectively aided by use of concentric rings 26 and radial lines 27 defined on the under surface of the medial portion of the base plate. The centering of the original router work support plate is not necessary so long as from the work support plate portion established the handles and all other parts of the router to be supported fit through the orifice 41 defined in a support table and the router shaft 45 and cutter 46 will pass through the orifice 17 defined in the base plate, after removal or placement of any inserts 11 as may be necessary. Normally however, the router is easier to use if it is centered relative to the base plate to present a more familiar view of a work area than if the router were asymmetrically positioned.

With the router work support plate centered on the base plate, it is temporarily fastened by clamping or other similar means to the base plate and router support holes 32 are drilled through the base or inserts 11 as may be required to coincide with the holes defined in the feet 48 of the router support arms 47. The work support plate 14 then is removed from the base plate and the upper orifices of holes 32 are chamferred as necessary to receive countersinkable heads of fasteners 49 that originally fastened the router work support plate to the support arms 47, with the fastener heads flush with and not projecting above the upper surface of the base plate 10.

The router 43 then is positioned on the upturned under surface of support plate 10. The holes defined in its support arm feet 48 are aligned with the holes 32 created in the support plate and fasteners 49 that originally fastened the router to its work support plate are inserted through the feet 48 and into fastenable interconnection with the base plate by means of threaded engagement of the bolts within threaded holes defined in the support feet 48,in the same fashion as the router support plate was originally fastened to the support arms 47.

With the router fastened to the base plate 10 to depend therefrom and router shaft 45 and cutter 46 extending through router bit orifice 17 and any inserts that are used, the base plate 10 is turned over and inserted into orifice 41 in support table 40 until the peripheral portions of the support plate are supported on ledge 42 in support table orifice 41. The support plate and depending router will then be supported and positionally maintained in the support table orifice by action of gravity.

The base plate then may be vertically aligned in the support table as necessary by adjustment of the leveler screws 33, 53 to bring the upper surface of its peripheral edges into coplanar relationship with the adjacent edges orifice edges of the upper surface of the support table. The base plate 10 then is fastened for positional maintenance in the orifice 41 by means of corner fasteners 13. Fastening bolts 35 are loosened if necessary and fastening dogs 36 moved as required to allow fastening ledges 39 to be engaged beneath the under surface of the support table adjacent orifice 41 or curved end surfaces 39*a* moved into frictional adjacency with the ledge 42. With the fastening dogs maintained in this fastening position, nuts 37 are tightened on bolts 25 to create and maintain some force between the adjacent surfaces of the fastening dogs and ledge 42 of the support table for releasable maintenance of these members relative to each other. The router then is supported in operation position and ready for use as a stationary tool.

The foregoing description of my invention is necessarily of a detailed nature so that a specific embodiment of it might me set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A base plate, for mounting a powered hand manipulatable router having a shaft carrying a cutter in a horizontal support table defining an orifice having an inwardly extending ledge about the lower portion of the orifice to receive and support the base plate, comprising in combination:

a base plate configured to fit in the orifice defined in the support table with at least a portion of the peripheral edge of the base plate supported on the upper surface of the ledge extending inwardly about the support table orifice, said base plate defining an orifice to allow the passage of the router shaft through the orifice and spacedly above the base plate to operatively carry a cutter above the base plate;

leveler means carried by the ledge about the support table orifice to contact the base plate to vertically move the base plate relative to the support table responsive to motion of the leveler means, at least one fastening means carried by the support plate adjacent the periphery thereof including a bolt, depending through the base plate and spacedly therebelow, carrying an elongate fastening dog to contact the support table and a threadedly engaged nut outwardly of the fastening dog to move the fastening dog toward the base plate to fasten the support plate in the support table.

2. The base plate of claim 1 wherein the fastening dog further comprises:

an elongate body with first and second ends;

an elongate slot extending vertically through the elongate body to slidably and rotatably carry the fastening bolt;

a fastening ledge extending from the first end of the elongate body to engage and fasten under the support table carrying the base plate and a second end having an arcuate configuration parallel to the bolt carrying the fastening dog.

3. The base plate of claim 1 further characterized by:

means carried on the under surface of the base plate to aid centering a router on the base plate including plural circular lines concentric about the center of the orifice defined in the support plate and plural spaced radial lines extending perpendicularly through the circular lines.

4. The base plate of claim 1 having leveling means comprising:

at least one screw threadedly engaged in the ledge defined about the support table orifice for upward extension therefrom to move a periphery portion of the base plate adjacent the screw vertically away from the ledge supporting the base plate periphery.

5. The leveling means of claim 4 further having a sleeve threadedly carrying the screw and embedded in the ledge to provide greater durability and strength for the threaded interconnection.

6. The base plate of claim 1 carrying a router depending beneath the base plate with a cutter shaft extending upwardly through the orifice defined in the base plate and spacedly above the base plate.

7. In a base plate, for mounting a depending router with the router shaft extending through a medial orifice defined in the base plate, for carriage in an orifice defined in a horizontal support table with an inwardly extending ledge defined about the lower portion of the orifice to support a peripheral portion of the base plate, the invention comprising:

at least one fastening means carried by the base plate including a bolt depending through a peripheral area of the base plate and spacedly therebelow to carry an elongate fastening dog defining an elongate medial slot to movably carry the bolt therein and a fastening ledge extending from one end of the fastening dog with a nut threadedly engaged on the bolt outwardly of the fastening dog to move the one fastening dog toward and away from the base plate and fasten against the support table to positionally maintain the base plate in the orifice defined in the support table.

* * * * *